US011747080B2

(12) United States Patent
Wang et al.

(10) Patent No.: US 11,747,080 B2
(45) Date of Patent: Sep. 5, 2023

(54) ICE MACHINE, FAULT HANDLING METHOD AND FAULT HANDLING APPARATUS FOR ICE MACHINE, AND REFRIGERATION DEVICE

(71) Applicants: HEFEI HUALING CO., LTD., Anhui (CN); HEFEI MIDEA REFRIGERATOR CO., LTD., Anhui (CN); MIDEA GROUP CO., LTD., Guangdong (CN)

(72) Inventors: Jincai Wang, Anhui (CN); Yang Shao, Anhui (CN); Guangqing Yang, Anhui (CN); Zengqiang Si, Anhui (CN); Yabing Wu, Anhui (CN)

(73) Assignees: HEFEI HUALING CO., LTD., Anhui (CN); HEFEI MIDEA REFRIGERATOR CO., LTD., Anhui (CN); MIDEA GROUP CO., LTD., Guangdong (CN)

( * ) Notice: Subject to any disclaimer, the term of this patent is extended or adjusted under 35 U.S.C. 154(b) by 288 days.

(21) Appl. No.: 16/772,659

(22) PCT Filed: Dec. 12, 2018

(86) PCT No.: PCT/CN2018/120499
§ 371 (c)(1),
(2) Date: Jun. 12, 2020

(87) PCT Pub. No.: WO2019/114736
PCT Pub. Date: Jun. 20, 2019

(65) Prior Publication Data

US 2021/0080170 A1 Mar. 18, 2021

(30) Foreign Application Priority Data

Dec. 15, 2017 (CN) ..... 201711350524.3

(51) Int. Cl.
*F25D 29/00* (2006.01)
*F25C 1/22* (2018.01)

(52) U.S. Cl.
CPC ..... *F25D 29/008* (2013.01); *F25C 1/22* (2013.01); *F25C 2500/08* (2013.01); *F25D 2600/06* (2013.01)

(58) Field of Classification Search
CPC .... F25D 29/008; F25D 2600/06; F25D 29/00; F25C 1/22; F25C 2500/08; F25C 5/08;
(Continued)

(56) References Cited

U.S. PATENT DOCUMENTS

| | | | | |
|---|---|---|---|---|
| 4,573,325 A * | 3/1986 | Chiu | F25C 5/08 62/233 |
| 6,574,974 B1 * | 6/2003 | Herzog | F25C 1/04 62/135 |
| 2004/0194480 A1 * | 10/2004 | Kim | F25C 1/04 62/340 |

FOREIGN PATENT DOCUMENTS

| | | |
|---|---|---|
| CN | 1435619 A | 8/2003 |
| CN | 1543558 A | 11/2004 |

(Continued)

*Primary Examiner* — Cassey D Bauer
(74) *Attorney, Agent, or Firm* — Seed IP Law Group LLP

(57) ABSTRACT

An ice machine, a fault handling method and fault handling apparatus of the ice machine, and a refrigeration device. The ice machine includes an ice machine body, an ice making tray located in the ice machine body, a heating assembly, and an ice stirring assembly for stirring out ice made in the ice making tray. A fault of an ice stirring assembly is automatically removed by means of a heating treatment mode of gradually raising a heating temperature multiple times, the method and apparatus moving simply and quickly, wherein the satisfaction degree of users is improved.

17 Claims, 5 Drawing Sheets

(58) Field of Classification Search
CPC ..... F25C 2305/024; F25C 2700/06; F25C 2700/12
See application file for complete search history.

(56) References Cited

FOREIGN PATENT DOCUMENTS

| | | | |
|---|---|---|---|
| CN | 103154647 | A | 6/2013 |
| CN | 205957576 | U | 2/2017 |
| CN | 106918173 | A | 7/2017 |
| CN | 107144082 | A | 9/2017 |
| CN | 107388666 | A | 11/2017 |
| CN | 107576117 | A | 1/2018 |
| CN | 107702395 | A | 2/2018 |
| CN | 108151387 | A | 6/2018 |
| KR | 2002-0085415 | A | 11/2002 |
| KR | 10-2015-0145705 | A | 12/2015 |

* cited by examiner

ICE MACHINE, FAULT HANDLING METHOD AND FAULT HANDLING APPARATUS FOR ICE MACHINE, AND REFRIGERATION DEVICE

CROSS-REFERENCE TO RELATED APPLICATIONS

This application claims a priority to Chinese Patent Application Serial No. 201711350524.3, filed with the State Intellectual Property Office of P. R. China on Dec. 15, 2017, titled with "ICE MACHINE, FAULT HANDLING METHOD AND FAULT HANDLING APPARATUS OF ICE MACHINE, AND REFRIGERATION DEVICE", with HEFEI HUALING CO., LTD., HEFEI MIDEA REFRIGERATOR CO., LTD. and MIDEA GROUP CO., LTD. as applicants, the entire content of which is incorporated herein by reference.

FIELD

The present disclosure relates to the field of electrical appliance manufacturing technology, and in particular relates to a fault handling method for an ice machine and a fault handling apparatus of an ice machine, as well the ice machine and a refrigeration device.

BACKGROUND

It is a development trend to provide a refrigeration device (e.g., a refrigerator) with an ice machine. In some developed regions such as Europe and America, a high-end refrigerator is generally equipped with an ice machine. After made in the ice machine, ice is pulled out to an ice storing bin by an ice pulling-out component, during which if the ice pulling-out component is frozen or stuck by ices, a fault alarm will be triggered. FIG. 1 shows a control logic method in the related art, which includes:

S10', to make ice.

S20', to determine whether an ice pulling-out component is frozen or stuck by ices, if yes, execute step S30', otherwise return to step S10'.

S30', to stop making ice and to alarm the fault.

In short, the existing ice machine is unable to eliminate a fault by itself when the ice pulling-out component is frozen or stuck by ices, which, thus, needs to be handed manually.

SUMMARY

Embodiments of the present disclosure seek to solve at least one of the problems existing in the related art to a certain extent.

To this end, the present disclosure proposes, in embodiments, a fault handling method for an ice machine which can automatically eliminate a fault occurring in an ice pulling-out component, resulting in more convenience.

The present disclosure also provides in embodiments a fault handling apparatus of an ice machine, and an ice machine and a refrigeration device.

To solve the above problem, in a first aspect, the present disclosure proposes in embodiments a fault handling method for an ice machine, including: detecting and determining that a fault occurs in an ice pulling-out component; and controlling a heating component to heat under one or more gradually increasing preset target temperatures.

In embodiments of the present disclosure, by multiple heating under the gradually increasing temperatures, the fault handling method for an ice machine can automatically eliminate the fault where the ice pulling-out component is frozen or stuck by ices, allowing the ice pulling-out component to return to normal operations, which is more convenient and efficient relative to manual elimination, thus improving user's satisfaction.

In some embodiments of the present disclosure, detecting and determining that a fault occurs in an ice pulling-out component includes: completing ice pulling-out control of the ice pulling-out component, and collecting a reset signal of the ice pulling-out component; detecting the reset signal and determining that the ice pulling-out component is not reset to an equilibrium position; and determining that the ice pulling-out component is stuck by ices.

In some embodiments of the present disclosure, detecting and determining that a fault occurs in an ice pulling-out component includes: controlling the ice pulling-out component to execute an ice pulling-out action according to an ice pulling-out control signal; and determining that the ice pulling-out component is frozen when the ice pulling-out action fails.

In some embodiments of the present disclosure, controlling a heating component to heat under one or more gradually increasing preset target temperatures includes: controlling the heating component to heat for a first preset time period under a first preset target temperature higher than an ice detaching temperature; controlling the heating component to heat for a second preset time period under a second preset target temperature higher than the first preset target temperature; and controlling the heating component to heat under gradually increasing preset target temperatures until the gradually increasing preset target temperatures achieve a third preset target temperature, thereby achieving automatic fault elimination.

In some embodiments of the present disclosure, the third preset target temperature is 105° C.

In some embodiments of the present disclosure, the fault handling method for an ice machine further includes: controlling the heating component to heat under the third preset target temperature for a third preset time period, and acquiring a temperature in an ice making tray; and controlling the heating component to stop heating when the temperature in the ice making tray achieves a preset evaporating temperature.

In some embodiments of the present disclosure, the fault handling method for an ice machine further includes: controlling the heating component to continue heating under the third preset target temperature when the temperature in the ice making tray is lower than the preset evaporating temperature.

In some embodiments of the present disclosure, the ice machine includes an ice storing bin configured to store ices pulled out of the ice making tray; and a switch for the ice storing bin, wherein the fault handling method further includes: determining that a fault occurs in the ice pulling-out component, and detecting that a time period during which the switch for the ice storing bin is dislocated is less than a preset manually handling time period; and controlling the heating component to heat under the one or more gradually increasing preset target temperature, thereby avoiding that ices stuck or frozen at the ice pulling-out component have been found and manually handled by a user.

The present disclosure further proposes in embodiments a device, including at least one processor; a memory; and at least one program, stored on the memory and implementing, when executed by the at least one processor, a fault handling method for an ice machine according to embodiments in the first aspect of the present disclosure.

The present disclosure further proposes in embodiments a non-transitory computer readable storage medium having stored therein a computer program that, when executed, implements a fault handling method for an ice machine according to embodiments in the first aspect of the present disclosure.

To solve the above problem, in a second aspect, the present disclosure proposes in embodiments a fault handling apparatus of an ice machine, including: a first detecting module, configured to detect and determine that a fault occurs in an ice pulling-out component; and a controlling module, configured to control a heating component to heat under one or more gradually increasing preset target temperatures.

In embodiments of the present disclosure, by multiple heating under the gradually increasing temperatures, the fault handling apparatus for an ice machine can automatically eliminate the fault where the ice pulling-out component is frozen or stuck by ices, allowing the ice pulling-out component to return to normal operations, which is more convenient and efficient relative to manual elimination, thus improving user's satisfaction.

In some embodiments of the present disclosure, the first detecting module includes: a collecting unit, configured to collect a reset signal of the ice pulling-out component after completing ice pulling-out control; and a determining unit, configured to detect the reset signal, to determine that the ice pulling-out component is not reset to an equilibrium position, and to determine that the ice pulling-out component is stuck by ices.

In some embodiments of the present disclosure, the controlling module is configured to control the ice pulling-out component to execute an ice pulling-out action according to an ice pulling-out control signal; and the first detecting module includes: a detecting unit, configured to detect an ice pulling-out action signal for the ice pulling-out component; and a determining unit, configured to determine that the ice pulling-out action fails according to the ice pulling-out action signal and to determine that the ice pulling-out component is frozen.

In some embodiments of the present disclosure, the controlling module is configured: to control the heating component to heat for a first preset time period under a first preset target temperature higher than an ice detaching temperature; to control the heating component to heat for a second preset time period under a second preset target temperature higher than the first preset target temperature; and to control the heating component to heat under gradually increasing preset target temperatures until the gradually increasing preset target temperatures achieve a third preset target temperature, thereby achieving automatic fault elimination.

In some embodiments of the present disclosure, the third preset target temperature is 105° C.

In some embodiments of the present disclosure, the fault handling apparatus of an ice machine further includes: an acquiring module, configured to acquire a temperature in an ice making tray after the controlling module controls the heating component to heat under the third preset target temperature for a third preset time period; and wherein the controlling module is further configured to control the heating component to stop heating when the temperature in the ice making tray achieves a preset evaporating temperature.

In some embodiments of the present disclosure, the controlling module is further configured to control the heating component to continue heating under the third preset target temperature when the temperature in the ice making tray is lower than the preset evaporating temperature.

In some embodiments of the present disclosure, the ice machine includes an ice storing bin configured to store ices pulled out of the ice making tray; and a switch for the ice storing bin, wherein the fault handling apparatus of an ice machine further includes a second detecting module, configured to detect that a fault occurs in the ice pulling-out component and to detect that a time period during which the switch for the ice storing bin is dislocated is less than a preset manually handling time period; and wherein the controlling module is configured to control the heating component to heat under the one or more gradually increasing preset target temperature, thereby avoiding that ices stuck or frozen at the ice pulling-out component have been found and manually handled by a user.

Based on the fault handling apparatus of an ice machine described in the above embodiments of the present disclosure, in a third aspect, the present disclosure proposes in embodiments an ice machine, including an ice machine body, an ice making tray located in the ice machine body, a heating component, a temperature sensor and an ice pulling-out component for pulling out ices made in the ice making tray; and a fault handling apparatus of an ice machine.

With the fault handling apparatus of an ice machine described in the above embodiments of the present disclosure, the ice machine according to embodiments of the present disclosure can achieve automatic elimination of the fault where the ice pulling-out component is frozen or stuck by ices, which is more convenient and efficient relative to manual elimination, thus improving user's satisfaction.

Based on the ice machine described in the above embodiments of the present disclosure, in a fourth aspect, the preset disclosure proposes in embodiments a refrigeration device, including an ice machine as described above. With the ice machine described in the above embodiments of the present disclosure, the refrigeration device can achieve automatic elimination of the fault where the ice pulling-out component is frozen or stuck by ices, thus improving user's satisfaction for the product.

Figure 1:
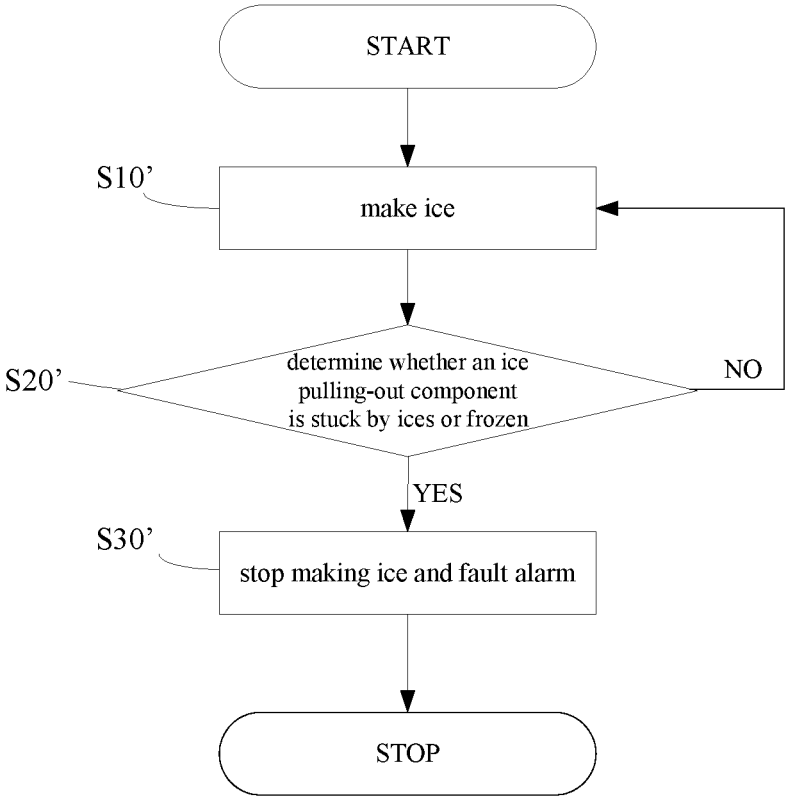
FIG. 1 is a flow chart showing a fault logic controlling method for an ice machine in the related art.

| REFERENCE |
| --- |
| 1000: refrigeration device<br>100: ice machine;<br>10: ice machine body; 20: ice making tray; 30: ice pulling-out component; 40: heating component; 50: temperature sensor and drive motor; 60: plastic baffle; 70: ice detecting rod; 80: fault handling apparatus of the ice machine<br>81: first detecting module; 82: controlling module; 83: acquiring module; 84: second detecting module;<br>811: collecting unit; 813: determining unit; and 814: detecting unit. |

DETAILED DESCRIPTION

Descriptions will be made in detail to embodiments of the present disclosure, examples of the embodiments are shown in drawings, in which the same or similar elements and the elements having same or similar functions are denoted by like reference numerals throughout the descriptions. The embodiments described herein with reference to drawings are explanatory, are intended to illustrate the present disclosure, and are not construed to limit the present disclosure.

First, a brief introduction is made to the structure of the ice machine according to embodiments of the present disclosure.

Figure 2:
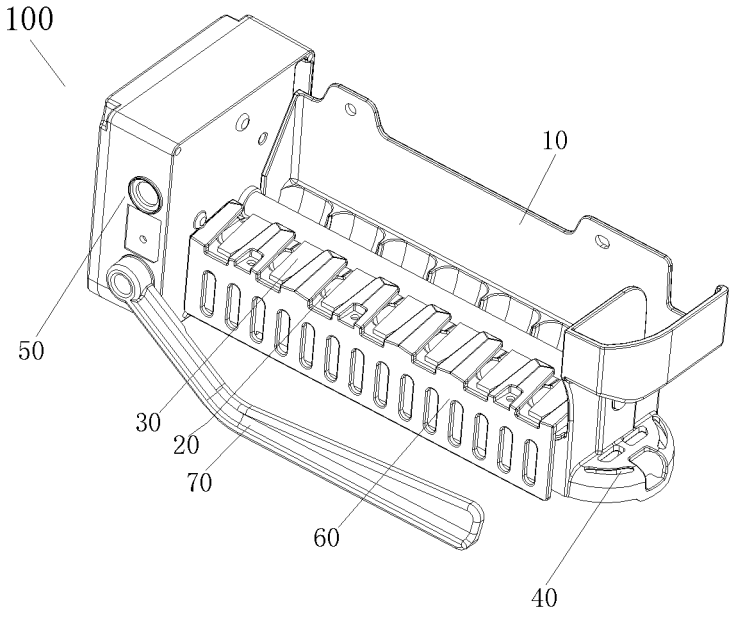
FIG. 2 is a schematic diagram showing an ice machine according to embodiments of the present disclosure.

As shown in FIG. 2, in embodiments of the present disclosure, the ice machine 100 includes an ice machine body 10, an ice making tray 20, an ice pulling-out component 30, a heating component 40, a temperature sensor and a drive motor 50. The following may also be included: an ice storing bin and a switch for the ice storing bin (not shown), a plastic baffle 60, an ice detecting rod 70 for detecting an ice amount in the ice storing bin. The ice machine body 10 may be made of metal. The ice making tray 20, located in the ice machine body 10, may be filled with water, which can be cooled by air cooling or otherwise to form ice. The ice pulling-out component 30 is configured to pull-out ices made in the ice making tray 20, for example to the ice storing bin. The heating component 40 is configured to heat. Under proper heating, a water film is formed between the ice and the ice making tray 20, thus facilitating ices to be pulled out by the ice pulling-out component 30, for easy access of ices from the ice storing bin by users.

Description is made below with reference to drawings for a fault handling method for an ice machine according to embodiments in a first aspect of the present disclosure.

Figure 3:
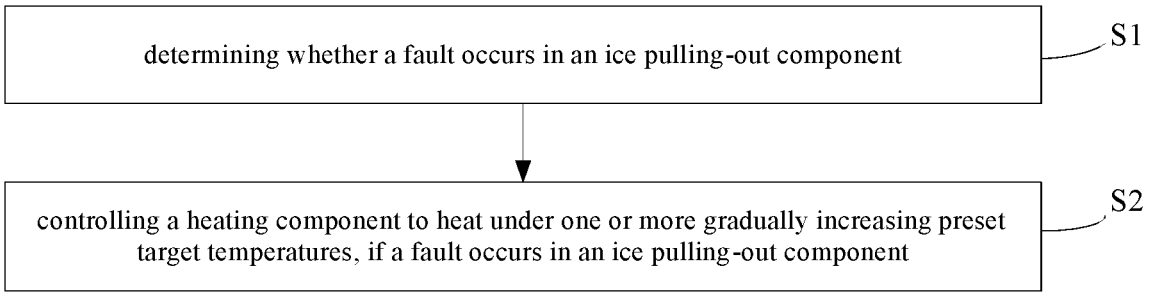
FIG. 3 is a flow chart showing a fault handling method for an ice machine according to embodiments of the present disclosure.

FIG. 3 is a flow chart showing a fault handling method for an ice machine according to embodiments of the present disclosure. As shown in FIG. 3, in embodiments of the present disclosure, the fault handling method for an ice machine includes S1 and S2.

At S1, whether a fault occurs in an ice pulling-out component is determined.

Specifically, an ice pulling-out component pulls out ices made in an ice making tray, for example to an ice storing bin for easy access by users. The phenomenon that the ice pulling-out component is unable to move when ices are pulled out of the ice making tray is referred to as "stuck by ices" herein in embodiments of the present disclosure.

In some embodiments of the present disclosure, a reset signal of the ice pulling-out component is collected after completion of ice pulling-out control of the ice pulling-out component; and whether the ice pulling-out component is reset to an equilibrium position is determined according to the reset signal. After transferring ices from the ice making tray to the ice storing bin, the ice pulling-out component will be reset, for example as shown in FIG. 2, back to a no-action condition, e.g., a horizontal position. If the ice pulling-out component is not reset to the equilibrium position, it is determined that the ice pulling-out component is stuck by ices and, thus, unable to move, that is, a fault occurs.

In some other embodiments of the present disclosure, the ice pulling-out component is easily frozen during ice making as a result of being arranged close to the ice making tray, as shown in FIG. 2. The ice pulling-out component being frozen or an invalid ice pulling-out action caused by another reason will be regarded as a fault occurring in the ice pulling-out component. In specific, the ice pulling-out component is controlled to execute an ice pulling-out action according to an ice pulling-out control signal. For example where ice thickness achieves a preset value, the ice pulling-out control signal is sent after completion of an ice detaching step. Detection of the ice pulling-out action signal includes for example detection of a change of the ice amount in the ice storing bin. If the ice pulling-out action fails, for example, the ice pulling-out component is unable to pull ices out of the ice making tray to the ice storing bin or an ice detecting rod is unable to detect a change of the ice amount in the ice storing bin, it is determined that the ice pulling-out component is frozen.

At S2, the heating component is controlled to heat under one or more gradually increasing preset target temperatures if a fault occurs in the ice pulling-out component.

In embodiments of the present disclosure, when the ice pulling-out component is frozen or stuck by ices, instead of a direct fault alarm, multiple heatings under gradually increasing temperatures can automatically eliminate the fault occurring in the ice pulling-out component, allowing the ice pulling-out component to return to normal operation.

Specifically, in the case that a fault occurs in the ice pulling-out component, the heating component is controlled to heat for a first preset time period under a first preset target temperature higher than an ice detaching temperature. In some embodiments, once ices are formed from water in the ice making tray, the heating component is controlled to heat under the ice detaching temperature set in advance, such that a water film is formed between ice and the ice making tray, thus facilitating the ice pulling-out component to pull-out ices to the ice storing bin, i.e., an ice detaching process. The ice detaching temperature can be set in accordance to an actual situation, for example, set at ~8° C. In a specific example, the first preset target temperature may be set at a temperature 25° C. higher than the ice detaching temperature. When the ice pulling-out component is frozen or stuck by ices, the heating component is controlled to heat, to achieve the temperature 25° C. higher than the ice detaching temperature, lasting for 3 minutes, such that ices are melted and the fault where the ice pulling-out component is frozen or stuck by ices is eliminated.

The fault still existing in the ice pulling-out component indicates that heating under the first preset target temperature is not enough for melting ices, and then the heating component is controlled to heat for a second preset time period under a second preset target temperature higher than the first preset target temperature. For example, if the fault still exists in the ice pulling-out component, the heating component is controlled to heat at a temperature 50° C. higher than the ice detaching temperature for 3 minutes.

By analogy, if the fault still exists in the ice pulling-out component, the heating component is controlled to heat under gradually increasing preset target temperatures until a third preset target temperature is achieved, e.g., achieving a temperature 100° C. higher than the ice detaching temperature. By gradually increasing the heating temperature to melt ices, the fault where the ice pulling-out component is frozen or stuck by ices can be eliminated. For example, the third preset target temperature is 105° C.

According to embodiments of the present disclosure, when a fault occurs in the ice pulling-out component, the fault handling method for an ice machine can automatically eliminate the fault occurring in the ice pulling-out component by multiple heatings under gradually increasing preset target temperatures, which is more convenient and efficient relative to fault alarm and manual elimination, thus improving user's satisfaction.

In embodiments of the present disclosure, after controlling the heating component under the third preset target temperature for a third preset time period, a temperature in the ice making tray is acquired by, for example, a temperature sensor as shown in FIG. 2. If the temperature in the ice making tray achieves a preset evaporating temperature, e.g., 105° C., it will be determined that the water in the ice making tray is basically evaporated and, thus, the fault where the ice pulling-out component is frozen or stuck by ices has been eliminated, such that the heating component is controlled to stop heating. Alternatively, if the temperature of the ice making tray is lower than the preset evaporating temperature, the heating component is controlled to continue heating under the third preset target temperature to ensure fault elimination from the ice pulling-out component.

Further, in order to avoid ices stuck or frozen at the ice pulling-out component being found and manually handled by a user, in some embodiments of the present disclosure, after determination of a fault occurring in the ice pulling-out component, it is further determined whether a time period during which the switch for the ice storing bin is dislocated is greater than or equal to a preset manually handling time period. A switch signal of the switch for the ice storing bin can reflect whether the ice storing bin is taken out, and the time period during which the switch for the ice storing bin is dislocated refers to a time period that the ice storing bin has been taken out. The time period during which the switch for the ice storing bin is dislocated being less than the preset manually handling time period indicates that the fault occurring in the ice pulling-out component is not found by a user and thus the heating component is controlled to heat under the one or more gradually increasing preset target temperatures, to eliminate the fault automatically; otherwise, the time period during which the switch for the ice storing bin is dislocated being greater than or equal to the preset manually handling time period indicates that the fault occurring in the ice pulling-out component has been found by a user, which is or has been handled manually, and thus automatic fault elimination is no long needed.

Figure 4:
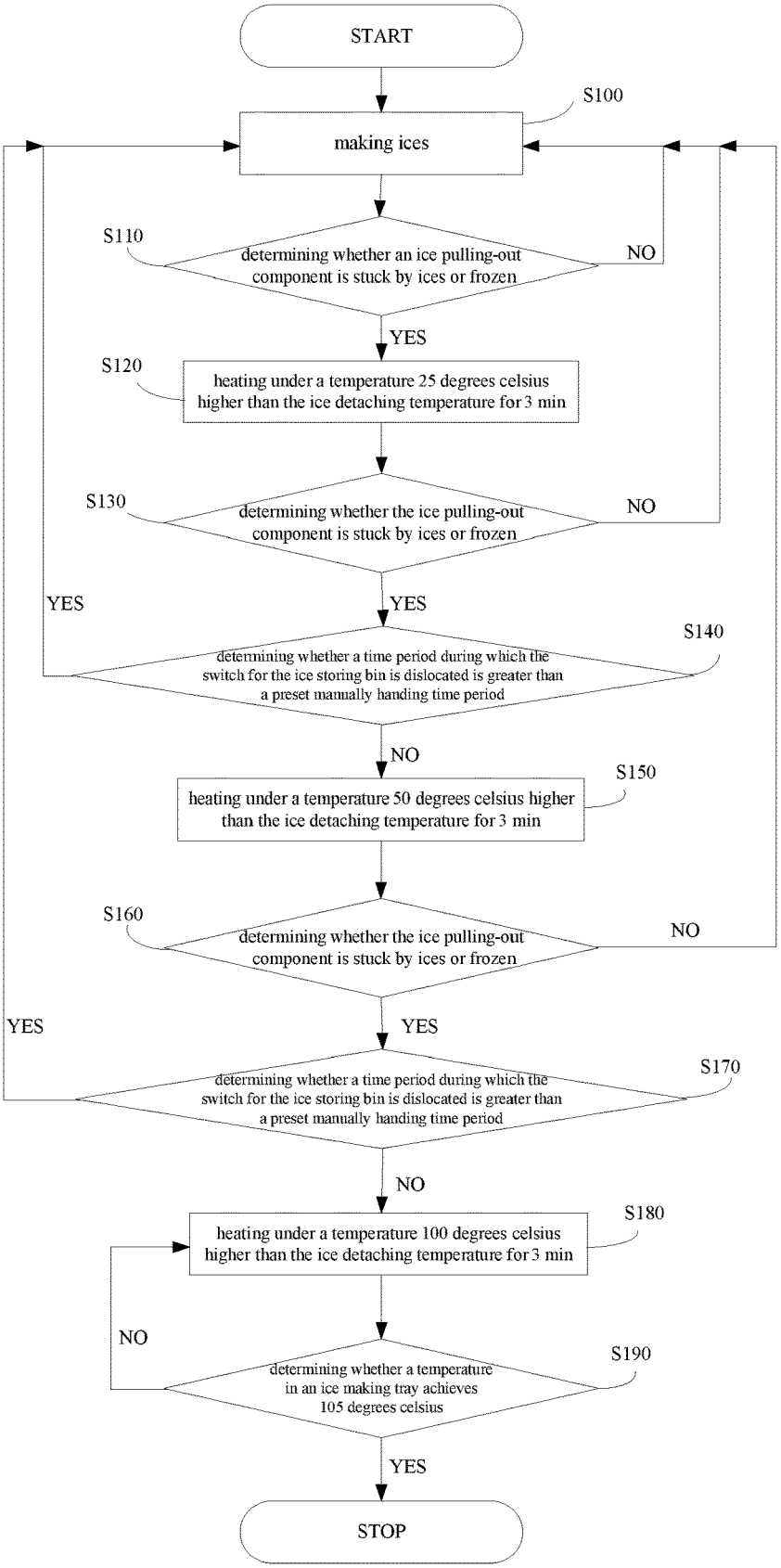
FIG. 4 is a flow chart showing a fault handling method for an ice machine according to an embodiment of the present disclosure.

In view of the above illustration, FIG. 4 is a flow chart showing a fault handling method for an ice machine according to an embodiment of the present disclosure. As shown in FIG. 4, the fault handling method includes steps of S100-S190.

S100: making ice

S110: determining whether an ice pulling-out component is frozen or stuck by ices; if yes, executing step S120; otherwise returning to step S100.

S120: heating under a temperature 25° C. higher than the ice detaching temperature for 3 minutes.

S130: determining whether the ice pulling-out component is frozen or stuck by ices; if yes, executing step S140; otherwise returning to step S100.

S140: determining whether a time period during which the switch for the ice storing bin is dislocated is greater than a preset manually handing time period, e.g., 2 minutes; if yes, returning to step S100, otherwise executing step S150.

S150: heating under a temperature 50° C. higher than the ice detaching temperature for 3 minutes.

S160: determining whether the ice pulling-out component is frozen or stuck by ices; if yes, executing step S170; otherwise returning to step S100.

S170: determining whether a time period during which the switch for the ice storing bin is dislocated is greater than the preset manually handing time period, e.g., 2 minutes; if yes, returning to step S100, otherwise executing step S180.

S180: heating under a temperature 100° C. higher than the ice detaching temperature for 3 minutes.

S190: determining whether a temperature in an ice making tray achieves 105° C.; if yes, water in the ice machine is basically evaporated and, thus, the fault has been eliminated, stopping the fault handling method, otherwise returning to step S180.

It should note that the preset target temperatures, temperature changing variation, and heating times can be modified according to the practical situation during the fault handling method in embodiments of the present disclosure. For example, the fault handling method can be performed several times in cycle. The specific parameters herein are not limited particularly.

In summary, in embodiments of the present disclosure, by multiple heating under the gradually increasing temperatures, the fault handling method for an ice machine can automatically eliminate the fault where the ice pulling-out component is frozen or stuck by ices, allowing the ice pulling-out component to return to normal operations, which is more convenient and efficient relative to manual elimination, thus improving user's satisfaction.

The present disclosure further proposes in embodiments a device, including at least one processor; a memory; at least one program, stored on the memory and implementing, when executed by the processor, a fault handling method for the ice machine as described in any above embodiment of the preset disclosure.

The present disclosure further proposes in embodiments a non-transitory computer readable storage medium having stored therein a computer program that, when executed, implements a fault handling method for the ice machine as described in above embodiments of the preset disclosure.

Description is made with reference to drawings for the fault handling apparatus of an ice machine according to embodiments of the present disclosure. The ice machine includes an ice machine body, an ice making tray located in the ice machine body, a heating component and an ice pulling-out component for pulling out ices made in the ice making tray.

Figure 5:
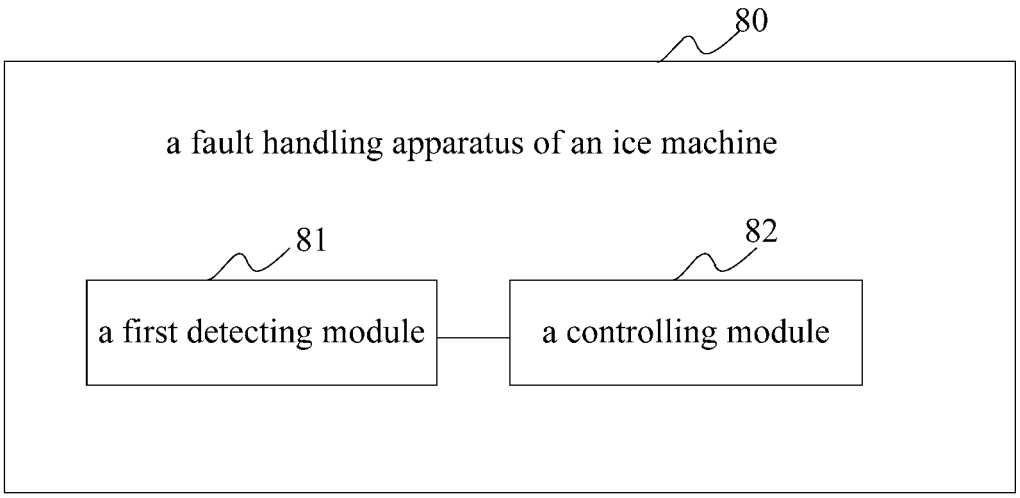
FIG. 5 is a block diagram showing a fault handling apparatus of an ice machine according to embodiments of the present disclosure.

FIG. 5 is a block diagram showing a fault handling apparatus of an ice machine according to embodiments of the present disclosure. As shown in FIG. 5, in an embodiment of the present disclosure, the fault handling apparatus of an ice machine includes a first detecting module 81 and a controlling module 82.

The first detecting module 81 is configured to determine whether a fault occurs in the ice pulling-out component. For example, the fault is determined to occur if the ice pulling-out component is frozen or stuck by ices. The controlling module 82 is configured to control a heating component to heat under one or more gradually increasing preset target temperatures when the fault occurs in the ice pulling-out component. By multiple heating under gradually increasing temperatures, ices can be melted such that the fault where the ice pulling-out component is frozen or stuck by ices can be eliminated.

Figure 6:
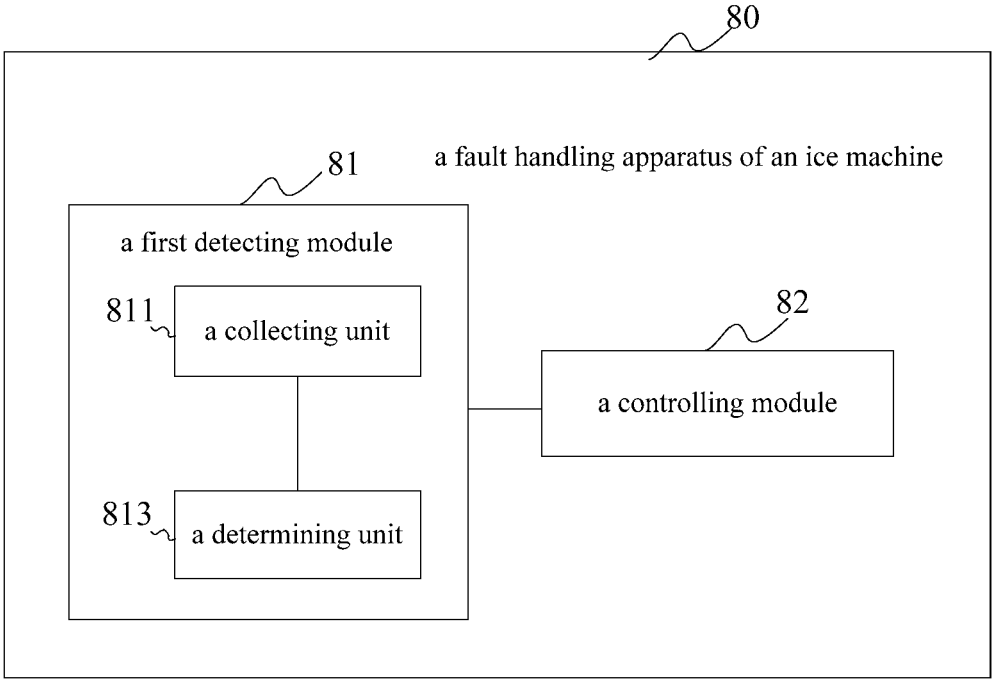
FIG. 6 is a block diagram showing a fault handling apparatus of an ice machine according to an embodiment of the present disclosure.

In some embodiments of the present disclosure, as shown in FIG. 6, the first detecting module 81 includes a collecting unit 811 and a determining unit 813. The collecting unit 811 is configured to collect a reset signal of the ice pulling-out component after completion of the ice pulling-out control. The determining unit 813 is configured to determine whether the ice pulling-out component is reset to an equilibrium position according to the reset signal, and to determine that the ice pulling-out component is stuck by ices, if the ice pulling-out component is not reset to the equilibrium position, that is, a fault occurs.

Figure 7:
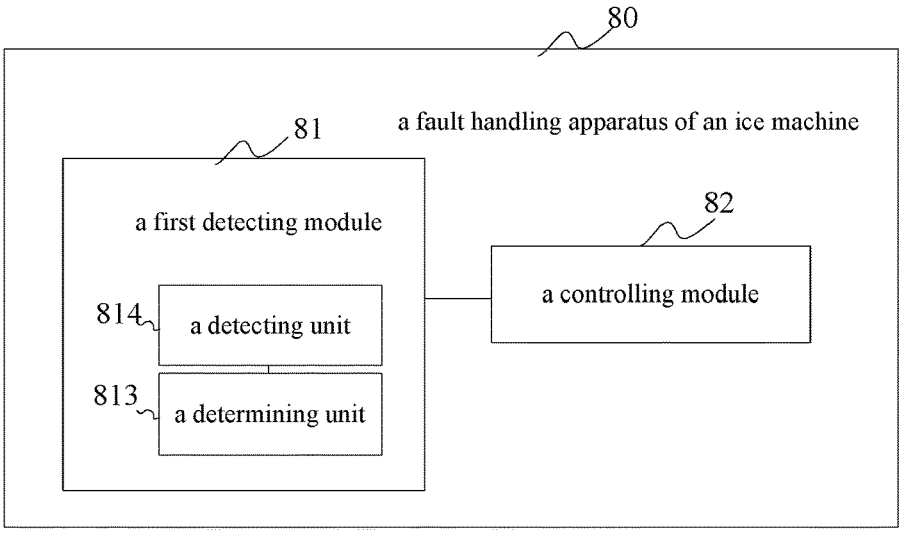
FIG. 7 is a block diagram showing a fault handling apparatus of an ice machine according to an embodiment of the present disclosure.

In some other embodiments of the present disclosure, as shown in FIG. 7, the first detecting module 81 includes a detecting unit 814 and a determining unit 813. The controlling module 82 is configured to control the ice pulling-out component to execute an ice pulling-out action according to an ice pulling-out control signal. The detecting unit 814 is configured to detect an ice pulling-out action signal for the ice pulling-out component. The determining unit 813 is configured to determine that the ice pulling-out component is frozen when determining that the ice pulling-out action fails according to the ice pulling-out action signal, i.e., a fault occurs.

Specifically, the controlling module 82 is configured to control the heating component to heat for a first preset time period under a first preset target temperature higher than an ice detaching temperature. When a fault still exists in the ice pulling-out component after being heated for the first preset time period, the heating component is controlled to heat for a second preset time period under a second preset target temperature higher than the first preset target temperature. When the fault still exists in the ice pulling-out component after being heated for the second preset time period, the heating component is controlled to heat under gradually increasing preset target temperatures until the gradually increasing preset target temperatures achieve a third preset target temperature, for example achieving to a temperature 100° C. higher than the ice detaching temperature. By multiple heatings under gradually increasing temperatures, ices are melted such that the fault where the ice pulling-out component is frozen or stuck by ices is eliminated. For example, the third preset target temperature is 105° C.

Figure 8:
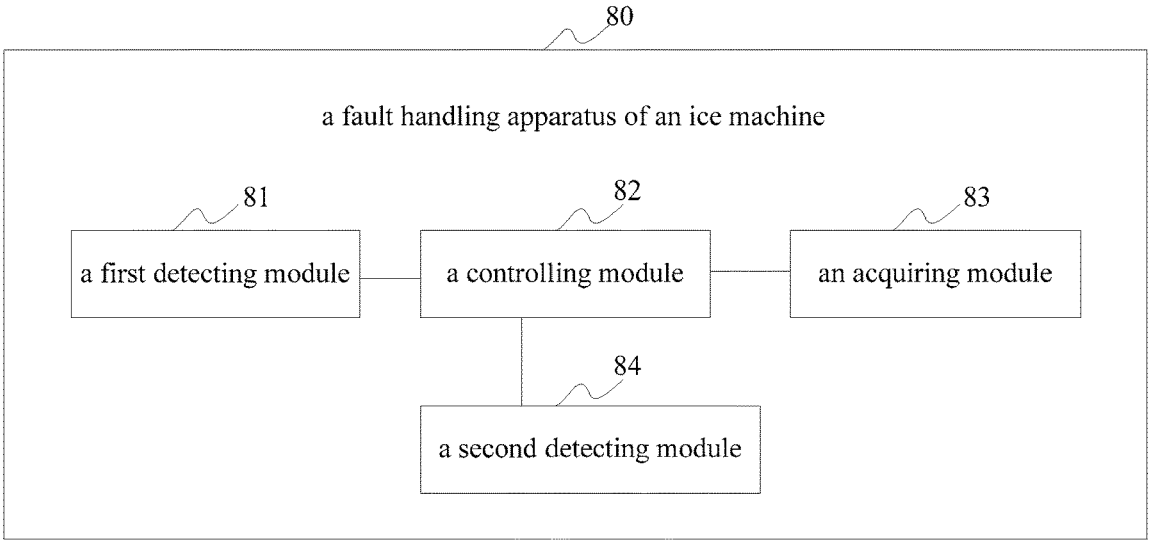
FIG. 8 is a block diagram showing a fault handling apparatus of an ice machine according to an embodiment of the present disclosure.

Further, in embodiments of the present disclosure, as shown in FIG. 8, the fault handling apparatus 80 of an ice machine may further include an acquiring module 83. The acquiring module 83 is configured to acquire a temperature in the ice making tray after the heating component is controlled to heat under the third preset target temperature for a third preset time period. The controlling module 82 is further configured to control the heating component to stop heating when the temperature in the ice making tray achieves a preset evaporating temperature, for example 105° C., (it will be determined that the water in the ice making tray is basically evaporated and, thus, the fault where the ice pulling-out component is frozen or stuck by ices has been eliminated); or to control the heating component to continue heating under the third preset target temperature when the temperature in the ice making tray is lower than the preset evaporating temperature, thereby ensuring fault elimination from the ice pulling-out component.

Further, in order to avoid ices stuck or frozen at the ice pulling-out component being found and manually handled by a user, in some embodiments of the present disclosure, the ice machine further includes an ice storing bin configured to store ices pulled out of the ice making tray; and a switch for the ice storing bin. As shown in FIG. 8, in some embodiments of the present disclosure, the fault handling apparatus 80 of an ice machine further includes a second detecting module 84. The second detecting module 84 is configured to determine whether a time period during which the switch for the ice storing bin is dislocated is greater than or equal to a preset manual handling time period after determination that a fault occurred in the ice pulling-out component. The controlling module 82 is further configured to control the heating component to heat under the one or more gradually increasing target temperatures to eliminate the fault automatically when the time period during which the switch for the ice storing bin is dislocated is less than the preset manually handling time period (indicating that the fault occurring in the ice pulling-out component has not been found by a user); otherwise when the time period during which the switch for the ice storing bin is dislocated is greater than or equal to the preset manually handling time period, it is indicated that the fault occurring in the ice pulling-out component has been found by a user, which is or has been handled manually, and thus automatic fault elimination is no long needed.

In summary, in embodiments of the present disclosure, by multiple heating under the gradually increasing temperatures, the fault handling apparatus 80 of an ice machine can automatically eliminate the fault where the ice pulling-out component is frozen or stuck by ices, allowing the ice pulling-out component to return to normal operations, which is more convenient and efficient relative to manual elimination, thus improving user's satisfaction.

Based on the fault handling apparatus of an ice machine as described in the above embodiments of the present disclosure, description is made with reference to drawings for the ice machine according to embodiments in the third aspect of the present disclosure. As shown in FIG. 2, in an embodiment of the present disclosure, the ice machine 100 includes an ice machine body 10, an ice making tray 20 located in the ice machine body, a heating component 40, a temperature sensor and an ice pulling-out component 30 for pulling out ices made in the ice making tray 20; and the fault handling apparatus of an ice machine as described in the above embodiments. The specific working process of the fault handling apparatus of an ice machine is referred to the illustration in the above embodiments, which is not elaborated herein.

Figure 9:
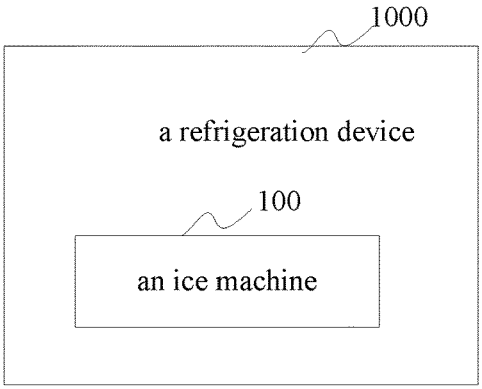
FIG. 9 is a block diagram showing a refrigeration device according to embodiments of the present disclosure.

In embodiment of the present disclosure, with the fault handling apparatus of an ice machine as described in the above embodiments, the ice machine 100 can achieve automatic elimination of the fault where the ice pulling-out component is frozen or stuck by ices, which is more convenient and efficient relative to manual elimination, thus improving user's satisfaction. As shown in FIG. 9, in embodiment of the present disclosure, the refrigeration device 1000 includes the ice machine 100 as described in the above embodiments. With the ice machine 100 as described in the above embodiments, the refrigeration device 1000 can achieve automatic elimination of the fault where the ice pulling-out component is frozen or stuck by ices, thus improving user's satisfaction.

It should be noted that, in the description of the present specification, any procedure or method described in the flow charts or described in any other way herein may be understood to comprise one or more modules, portions or parts for storing executable codes that realize particular logic functions or procedures. Moreover, advantageous embodiments of the present disclosure comprises other implementations in which the order of execution is different from that which is depicted or discussed, including executing functions in a substantially simultaneous manner or in an opposite order according to the related functions. This should be understood by those skilled in the art to which embodiments of the present disclosure belong.

The logic and/or step described in other manners herein or shown in the flow chart, for example, a particular sequence table of executable instructions for realizing the logical function, may be specifically achieved in any computer readable medium to be used by the instruction execution system, device or equipment (such as the system based on computers, the system comprising processors or other systems capable of obtaining the instruction from the instruction execution system, device and equipment and executing the instruction), or to be used in combination with the instruction execution system, device and equipment. As to the specification, "the computer readable medium" may be any device adaptive for including, storing, communicating, propagating or transferring programs to be used by or in combination with the instruction execution system, device or equipment. More specific examples of the computer readable medium comprise but are not limited to: an electronic connection (an electronic device) with one or more wires, a portable computer enclosure (a magnetic device), a random access memory (RAM), a read only memory (ROM), an erasable programmable read-only memory (EPROM or a flash memory), an optical fiber device and a portable compact disk read-only memory (CDROM). In addition, the computer readable medium may even be a paper or other appropriate medium capable of printing programs thereon. This is because, for example, the paper or other appropriate medium may be optically scanned and then edited, decrypted or processed with other appropriate methods when necessary to obtain the programs in an electric manner, and then the programs may be stored in the computer memories.

It should be understood that each part of the present disclosure may be realized by the hardware, software, firmware or their combination. In the above embodiments, a plurality of steps or methods may be realized by the software or firmware stored in the memory and executed by the appropriate instruction execution system. For example, if it is realized by the hardware, likewise in another embodiment, the steps or methods may be realized by one or a combination of the following techniques known in the art: a discrete logic circuit having a logic gate circuit for realizing a logic function of a data signal, an application-specific integrated circuit having an appropriate combination logic gate circuit, a programmable gate array (PGA), a field programmable gate array (FPGA), etc.

Those skilled in the art shall understand that all or parts of the steps in the above exemplifying method of the present disclosure may be achieved by commanding the related hardware with programs. The programs may be stored in a computer readable storage medium, and the programs comprise one or a combination of the steps in the method embodiments of the present disclosure when run on a computer.

Reference throughout this specification to "an embodiment", "some embodiments", "one embodiment", "another example", "an example", "a specific example" or "some examples" means that a particular feature, structure, material, or characteristic described in connection with the embodiment or example is included in at least one embodiment or example of the present disclosure. Thus, the appearances of the phrases such as "in some embodiments", "in one embodiment", "in an embodiment", "in another example", "in an example", "in a specific example" or "in some examples" in various places throughout this specification are not necessarily referring to the same embodiment or example of the present disclosure. Furthermore, the particular features, structures, materials, or characteristics may be combined in any suitable manner in one or more embodiments or examples. In addition, those skilled in the art may combine different embodiments or examples and combine features in the different embodiments or examples described in this specification without contradicting each other.

Although explanatory embodiments have been shown and described, it would be appreciated by those skilled in the art that the above embodiments cannot be construed to limit the present disclosure, and changes, alternatives, and modifications can be made in the embodiments in the scope of the present disclosure.

What is claimed is:

1. A fault handling method for an ice machine, the ice machine including an ice making tray and ice storing bin, the method comprising:

detecting and determining that a fault occurs in an ice pulling-out component of the ice machine;

detecting that a switch of the ice storage bin has not been dislocated for more than a preset manual handling time period; and controlling a heating component of the ice machine to heat based on one or more of a plurality of preset target temperatures that increase among one another in response to detecting the fault occurring in the ice pulling-out component and the switch of the ice storage bin not having been dislocated for more than the preset manual handling time period.

2. The fault handling method according to claim 1, wherein the detecting and determining that a fault occurs in the ice pulling-out component comprises:

controlling an ice pulling-out operation of the ice pulling-out component and collecting a reset signal of the ice pulling-out component;

analyzing the reset signal to determine that the ice pulling-out component is not reset to an equilibrium position; and determining that the ice pulling-out component is stuck by ices.

3. The fault handling method according to claim 1, wherein detecting and determining that a fault occurs in the ice pulling-out component comprises:

controlling the ice pulling-out component to execute an ice pulling-out operation according to an ice pulling-out control signal; and determining that the ice pulling-out component is frozen when the ice pulling-out action fails.

4. The fault handling method according to claim 1, wherein controlling the heating component to heat based on the one or more preset target temperatures comprises:

controlling the heating component to heat for a first preset time period based on a first preset target temperature of the one or more present target temperatures that is higher than an ice detaching temperature;

controlling the heating component to heat for a second preset time period based on a second preset target temperature of the one or more present target temperatures that is higher than the first preset target temperature; and controlling the heating component to heat based on preset target temperatures that increase over one another until the heating component is controlled to heat based on a third preset target temperature of the plurality of present target temperatures.

5. The fault handling method according to claim 4, wherein the third preset target temperature is 105° C.

6. The fault handling method according to claim 4, further comprising:

controlling the heating component to heat based on the third preset target temperature for a third preset time period, and acquiring a temperature in an ice making tray of the ice machine; and controlling the heating component to stop heating when the temperature in the ice making tray reaches a preset evaporating temperature.

7. The fault handling method according to claim 6, further comprising:

controlling the heating component to continue heating based on the third preset target temperature when the temperature in the ice making tray is lower than the preset evaporating temperature.

8. A device, comprising:

at least one processor;

a memory; and at least one program stored on the memory and implementing that, when executed by the at least one processor, executes acts including:

detecting and determining that a fault occurs in an ice pulling-out component of an ice machine;

detecting that a switch of the ice storage bin has not been dislocated for more than a preset manual handling time period; and controlling a heating component of the ice machine to heat based on one or more of a plurality of preset target temperatures that increase among one another in response to detecting the fault occurring in the ice pulling-out component and the switch of the ice storage bin not having been dislocated for more than the preset manual handling, time period.

9. An ice machine comprising a fault handling apparatus, an ice pulling-out component, an ice making tray, an ice storing bin, and a heating component, the fault handling apparatus including a processor and a memory, the memory having executable instruction stored thereon, which when processed by the processor, enable the processor to implement actions including:

a first detecting action that detects and determines that a fault occurs in the ice pulling-out component; and a second detecting action that detects that a switch of the ice storage bin has not been dislocated for more than a preset manual handling time period; and a controlling action that controls the heating component to heat based on one or more of a plurality of preset target temperatures that increase among one another in response to detecting the fault occurring in the ice pulling-out component and the switch of the ice storage bin not having been dislocated for more than the preset manual handling time period.

10. The ice machine according to claim 9, wherein the first detecting action comprises:

a collecting sub-action that collects a reset signal of the ice pulling-out component after the ice pulling-out component completes an ice pulling-out operation; and a determining sub-action that analyzes the reset signal to determine that the ice pulling-out component is not reset to an equilibrium position, and to determine that the ice pulling-out component is stuck by ice.

11. The ice machine according to claim 9, wherein the controlling action controls the ice pulling-out component to execute an ice pulling-out operation according to an ice pulling-out control signal; and the first detecting action comprises:

a detecting sub-action that detects the ice pulling-out action signal for the ice pulling-out component; and a determining sub-action that determines that the ice pulling-out operation fails according to the ice pulling-out action signal and to determine that the ice pulling-out component is frozen.

12. The ice machine according to claim 9, wherein the controlling action:

controls the heating component to heat for a first preset time period based on a first preset target temperature of the plurality of preset target temperatures that is higher than an ice detaching temperature;

controls the heating component to heat for a second preset time period based on a second preset target temperature of the plurality of preset target temperatures that is higher than the first preset target temperature; and controls the heating component to heat based on preset target temperatures that increase from one another until the heating component is controlled to heat based on a third preset target temperature of the plurality of preset target temperatures.

13. The ice machine according to claim 12, wherein the third preset target temperature is 105° C.

14. The ice machine according to claim 12, wherein the fault handling action includes acquiring a temperature in the ice making tray after the controlling action controls the heating component to heat based on the third preset target temperature for a third preset time period; and wherein the controlling action further controls the heating component to stop heating when the temperature in the ice making tray achieves a preset evaporating temperature.

15. The ice machine according to claim 14, wherein the controlling action further controls the heating component to continue heating based on the third preset target temperature when the temperature in the ice making tray is lower than the preset evaporating temperature.

16. The ice machine of claim 9, comprising:

an ice machine body, wherein the ice making tray is located in the ice machine body, and a temperature sensor.

17. A refrigeration device, comprising the ice machine according to claim 16.

* * * * *